United States Patent [19]

Omori

[11] Patent Number: 4,627,219

[45] Date of Patent: Dec. 9, 1986

[54] METHOD FOR BUNDLING PAPER SHEETS OR THE LIKE

[75] Inventor: Shozo Omori, Tokyo, Japan

[73] Assignees: Omori Machinery Co., Ltd., Kawasaki; Tokyo Shibaura Denki Kabushiki Kaisha, Tokyo, both of Japan

[21] Appl. No.: 640,214

[22] Filed: Aug. 13, 1984

Related U.S. Application Data

[63] Continuation of Ser. No. 370,819, Apr. 22, 1982, abandoned.

[30] Foreign Application Priority Data

Sep. 24, 1981 [JP] Japan ..... 56-141710[U]
Nov. 16, 1981 [JP] Japan ..... 56-169383[U]

[51] Int. Cl.[4] ..... B65B 11/02; B65B 61/20

[52] U.S. Cl. ..... 53/399; 53/415; 53/449

[58] Field of Search ..... 53/399, 137, 415, 542, 53/449; 206/451, 459; 229/87 R; 40/305

[56] References Cited

U.S. PATENT DOCUMENTS

| | | | |
|---|---|---|---|
| 454,105 | 6/1891 | Anderson | 206/459 |
| 1,148,233 | 7/1915 | Jefferson | 229/87 R |
| 1,269,630 | 6/1918 | Moore | 40/305 |
| 1,994,507 | 3/1935 | Farris | 53/176 |
| 2,034,747 | 3/1936 | Collins | 53/399 X |
| 2,259,866 | 10/1941 | Stokes | 53/415 |
| 2,260,064 | 10/1941 | Stokes | 53/415 |
| 2,713,966 | 7/1955 | Moulin . | |
| 2,728,450 | 12/1955 | Haire | 206/459 |
| 2,876,112 | 3/1959 | Vail | 229/87 R |
| 3,253,379 | 5/1966 | Foradora | 53/399 X |
| 3,564,815 | 2/1971 | Bescript | 53/229 |
| 3,805,473 | 4/1974 | Lidgard | 206/451 X |
| 3,896,524 | 7/1975 | Parker . | |
| 3,987,901 | 10/1976 | Dullinger | 206/451 |
| 3,991,524 | 11/1976 | White et al. . | |

*Primary Examiner*—John Sipos
*Attorney, Agent, or Firm*—Cushman, Darby & Cushman

[57] ABSTRACT

A bundle comprises a label which is placed on the center portion of upper side of a heaped up sheets of paper, on which an information for identification is described, and a transparent tape which is wound with the heaped up sheets of paper in one direction across the label, is made of a heat adhesible material. Both ends of the tape is heat adhered with each other. The tape is heat adhered to the label.

11 Claims, 4 Drawing Figures

METHOD FOR BUNDLING PAPER SHEETS OR THE LIKE

This is a continuation of application Ser. No. 370,819, filed Apr. 22, 1982 now abandoned.

BACKGROUND OF THE INVENTION

This invention relates to a bundle and a method for bundling any optional quantities of heaped up sheets of paper or the like.

Generally, for the purpose of facilitating easy handling and/or transferring of various kinds of sheets of paper such as letters, postcards, securities, certificates of stock, notes or the like are bundled in any optional quantities in the form of a parcel or package.

Conventional practice has been to bundle the paper sheets with string, or put the sheets into a bag. However, when paper sheets are bundled with string the goods will become damaged due to the string cutting into the edges of the bundled sheets of paper. In order to eliminate this disadvantage thick corner pads are typically applied on those places of the edges of the bundle where string is bound and tied. This extra-work, however, will present some practical problems of making the bundling operation more complicated, in addition to detracting from the appearance of the bundled goods. Similarly, containing the sheets in bags is not economical because extra packaging materials are required, and besides, the size of bags must be changed according to the variation of quantities of the contents, which makes the work very troublesome. For example, if the size of bags is limited to only one large size, and if the quantity of the contents is very small, there thus arise a problem that the goods contained in such a large bag will become loose and fall apart causing the goods inside the bag to collapse.

On the other hand, for the purpose of facilitating the recognition and identification of the kinds of paper contained in a bundled package, a labeling method is applied. Since it is not advantageous to fix a label onto the sheets of paper, labels are usually tied to the binding string or inserted between the paper and string. The manual work of tying labels onto the string is not only time-consuming but also is troublesome. Moreover, inserting a label between the paper and string presents a risk of the label falling off during handling and/or transferring of the goods. Thus both methods are not practical.

SUMMARY OF THE INVENTION

The present invention has been made in the light of the above described disadvantages, and the object of this invention is intended to provide an easy and secure bundle and method for bundling sheets of paper or the like including a practical means for labeling.

According to a first aspect of the present invention, there is provided a method for bundling sheets of paper which comprises a first step of stacking sheets of paper; and a second step of labeling of the stacked sheets of paper, wherein the first step includes a first process to bundle the stacked sheets of paper by winding a tape which is made of heat-sealable adhesive material in one direction; a second process of adhering one end of the wound tape with one part of the wound tape, and the second step includes a third process to place a label on which identifying information is described on one side of the stacked sheets of paper before the first process, in the first process the tape being wound around and across the label; and a fourth process to heat adhere the label to the tape.

According to a second aspect of the present invention, there is provided a method for bundling sheets of paper which is characterized in that the first step includes a first process to bundle the stacked sheets of paper by winding, in one direction a first tape which is made of a material which becomes adhesive upon the application of heat (hereinafter "heat adhesive material") a second process to adhere one end of the wound first tape with one part of the wound first tape; a third process to bundle the stacked sheets of paper by winding a second tape which is made of heat adhesive material in a direction perpendicular to the one direction after the second process; and a fourth process to adhere one end of the wound second tape with one part of the wound second tape, the second step includes a fifth process to place a label on one side of heaped up sheets of paper before the first process, in the first process said first tape being wound across the label, and in the third process said second tape being wound across the label; and a sixth process to heat adhere the label to the second tape.

According to a third aspect of the present invention, there is provided a bundle which comprises a label which is placed on one side of a heaped up sheets of paper, on which an information for identification is described; and a tape which is wound with the heaped up sheets of paper in one direction across the label, is made of heat adhesive material, one end of which is adhered with one part of the tape, and which is heat adhered to the label.

And, according to a fourth aspect of the present invention, there is provided a bundle which comprises a label which is placed on one side of a heaped up sheets of paper; and a first tape which is wound with the heaped up sheets of paper in one direction across the label, is made of heat adhesive material, one end of which is adhered with one part of the tape, and which is heat adhered to the label; and a second tape which is wound with the heaped up sheets of paper in a direction perpendicular to the one direction across the label, is made of heat adhesive material, one end of which is adhered with one part of the tape, and which is heat adhered to the label.

DETAILED DESCRIPTION OF THE PREFERRED EMBODIMENTS

A first embodiment of a bundle and a method for bundling sheets of paper or the like according to the present invention will be described in details with reference to FIG. 1 of accompanying drawings.

Figure 1:
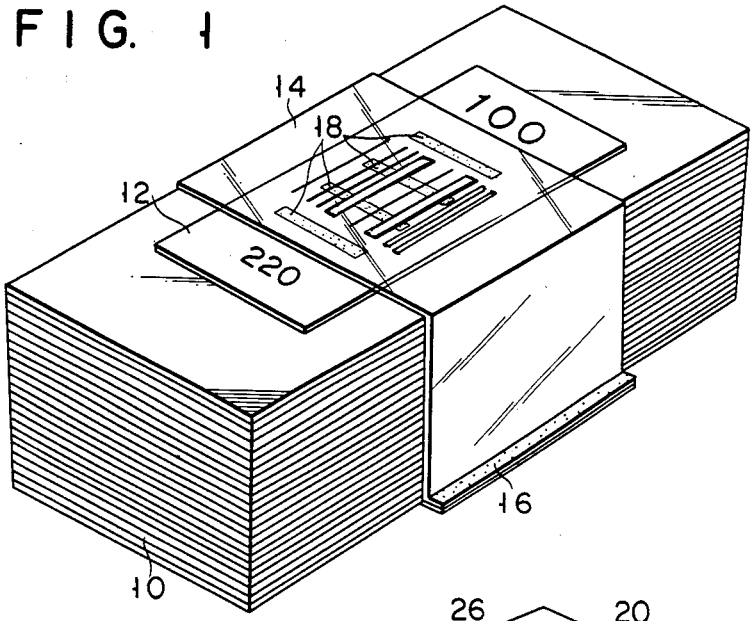
FIG. 1 is an oblique view showing a bundle of sheets of paper bound by a first embodiment of the method for bundling sheets of paper according to the present invention.

Reference numeral 10 in FIG. 1 represents a stack of a prescribed number of sheets of paper. For instance, in the case of this first embodiment, numeral 10 indicates a stack of postal material including postcards and enveloped letters. In the central part of the upper surface of stack 10, there is placed a label 12 on which all necessary information for the identification of this stack 10 such as the registered numbers of the original post office and the destination post office and the corresponding bar codes are printed and which is made of paper. Stack 10 is bound with a wide binding tape 14 as a bundle by a single winding along a direction perpendicular to the longitudinal direction of the stack 10 across the label 12. This binding tape 14 is made of hot melt adhesive transparent material and constructed with for instance, nylon-polyethylene laminated two-layer structural tape. This binding tape 14 firmly secures and holds the heap 10 by heat-melt adhesion on both ends.

Reference numeral 16 indicates a place where both ends of the binding tape 14 are hot melt adhered with each other. Likewise, the label 12 is affixed to tape 14 by heat adhesion. Reference numeral 18 shows a place where label 12 and tape 14 are hot melt adhered with each other.

Now, there will be described the method for bundling. First, a prescribed number of postal matters are stacked, and the stack 10 of postal material is made. The label 12 is placed on the center of the upper surface of stack 10. In this state, the stack 10 is bound with the tape 14 by one single winding across the label 12. Then in this state of holding the stack 10 tight, both ends of the tape are hot melt to adhere with each other. This heat adhesion is performed by a heating device (not shown) on four spots in the longitudinal direction of the stack 10 at a temperature of about 160° C. for a time of 0.3 through 0.5 sec. By virtue of this heating, the polyethylene sheet of the tape 14 melts and adheres on the surface of the label 12 so that the label 12 is easily and securely affixed to the tape 14.

The longitudinal length of the label 12 is preferably longer than the width of the tape 14. Namely, both ends in the longitudinal direction of the label 12 protrude a little from the edges of the tape 14, respectively, so that even should the heated portions slip away from stack 10, the tape 14 will not directly hot melt to postal material.

As described above, according to this first embodiment of the present invention, it is possible to make a secure and tight stack 10 of postal material regardless of the difference of size, volume, or quantities, since the stack 10 is tightly and securely bound by a wide tape 14 without the danger of damaging the edges of the heap 10.

Besides, since the tape 14 is transparent, it is possible to easily read and recognize the identification numbers, bar codes or any other information described on the label 12. Furthermore, the label 12 is easily and securely adhered to the tape 14 by means of hot melt adhesion. Therefore, there is no fear of the label 12 moving around or slipping off from the bundle 10 after it is bound.

This invention is not limited to the above-mentioned first embodiment, and various changes and modifications may be effected therein by one skilled in the art without departing from the scope or spirit of the invention.

For example, in the case of the first embodiment, the tape 14 is described as being made of transparent materials, but it may as well be made of opaque materials. In this case, the information such as numbers and bar codes to be described on the label 12 is printed on the salient parts of the label 12 from the tape 14 and the center part of the label 12, respectively. The tape 14, without being limited to the use of polyethylene, may as well use any other sheet materials which are capable of thermal adhesive. Tape 14 is also not limited to a two-layer structure. Moreover, there is no need of having four places 18 of hot melt adhesion between the label 12 and tape 14. As long as the tape 14 and label 12 are substantially and actually adhered together, only one place of adhesion is required to achieve the beneficial results of this invention. Similarly, the material for label 12 may well be any material without being limited to paper alone so long as its surface is printable.

As for the hot melt adhesion of label 12 to tape 14, it is not necessary to make it approximately simultaneous with the hot melt adhesion of both ends of tape 14 and thus adhesive of label 12 may be performed either before or after the heat adhesion of both ends of the tape 14. Further, in the case of the first embodiment, both ends of the label 12 are described as protruding outwardly from the edges of the tape 14, respectively, and thus label 12 may as well be part of the tape 14 where the tape 14 is made of transparent material.

Other embodiments of the bundle and the method for bundling sheets of paper according to the present invention are described as follows. In the description of various other embodiments to follow, like reference numerals refer to like elements.

Figure 2:
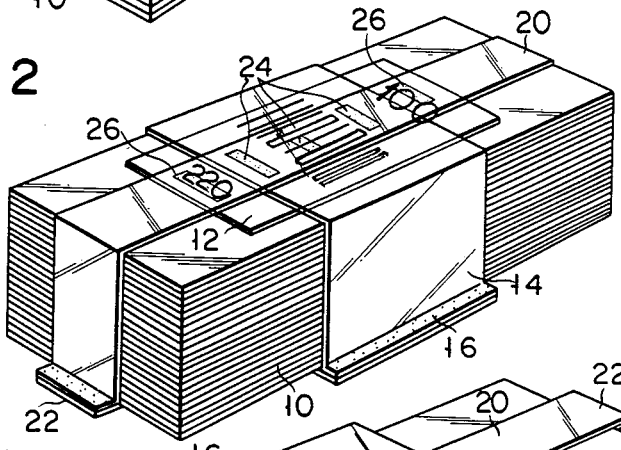
FIG. 2 is an oblique view showing a bundle of sheets of paper bound by a second embodiment according to the present invention.

FIG. 2 shows a second embodiment according to the present invention. In the second embodiment, the tape 14 and the label 12 are hot melt adhered after both ends of the tape 14 have been hot melt adhered. Before label 12 and tape 14 are hot melt adhered with each other, another wide tape 20 which is made of hot melt adhesive transparent material is bound around the stack 10 with one single winding directly crossing the tape 14 in such a way as to cut across the label 12. Namely, the tape 20 is bound across in the longitudinal direction of the label 12. Consequently, the stack 10 is bound by the tape 14 and the other tape 20 in the form of a crisscross. The tape 20 is hot melt adhered on both ends to hold and secure tightly these sides of the stack 10 which are not held by the tape 14. Reference numeral 22 indicates a place where both ends of the other tape 20 are hot melt adhered with each other.

After the other tape 20 is bound in the form of crisscrossing with the tape 14, tape 14 and the label 12, and the other tape 20 and the label 12 are simultaneously heat adhered respectively by the heating device (not shown). Reference numeral 24 indicates a place where the tape 14 and the label 12 are hot melt adhered, while reference numeral 26 shows a place where the other tape 20 and label 12 are hot melt adhered. That is, the heating device (not shown) is provided with a plurality heaters (five heaters in the second embodiment) over the entire length of the heating device which is longer than the width of the tape 14 but shorter than the longitudinal length of the label 12. Accordingly, salient portions of the label 12 protruding outwardly from the tape 14 are heat adhered via the heat adhesion area to the other tape 20 by the heaters mounted on both ends of the heating device, respectively, and since the three heaters are arranged in the middle part of the heating device, the overlapped portion of the tape 14 with the other tape 20 is hot melt adhered to the label 12.

According to the second embodiment, as the stack 10 is bound in the form of a crisscross by two tapes 14 and 12 its bundling force is further strengthened compared with the case of the first embodiment. In the second embodiment, it is not necessary to have the identifying information printed on the label 12 where the stack 10 is only transferred but not sorted.

Figure 3:
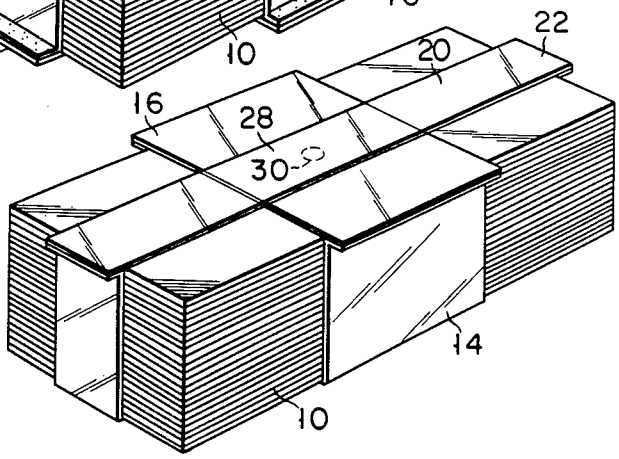
FIG. 3 is an oblique view showing a bundle of sheets of paper bound by a third embodiment according to the present invention, contrary to the above FIGS. 1 and 2, the bundle being placed upside down.

FIG. 3 depicts a third embodiment wherein the crossing point 28 where two tapes crisscross on the bottom side of the stack 10 may as well be adhered by means of a hot melt technique. In this case, a kind of polyolefin adhesive 30 heated up to a temperature of about 160° C. is employed for this hot melt technique. This kind of adhesive 30 is applied, after the tape 14 is bound and before the other tape 20 is bound, to that portion of the tape 14 which is crisscrossed by the other tape 20. Consequently, the other tape 20 is adhered to the tape 14 by the adhesive 30 on the bottom side of the stack 10 at a position where tape 20 crosses the tape 14. Thereafter, as explained in the second embodiment, on the upper side of the stack 10, the tape 14 and the label 12 and also the other tape 20 and the label 12 are respectively heat adhered with each other.

Thus according to the third embodiment, these two tapes 14 and 20, on the upper side of the heap 10 are heat adhered on the label 12 and and also heat adhered on the under side of the stack 10 by means of the hot melt technique at the crisscrossing parts with each other. Therefore, the bundling force by these two tapes 14 and 20 is greater stronger than in the case of the second embodiment, thus ensuring its safety against collapse of the stack 10 under a considerable degree of violent handling.

Figure 4:
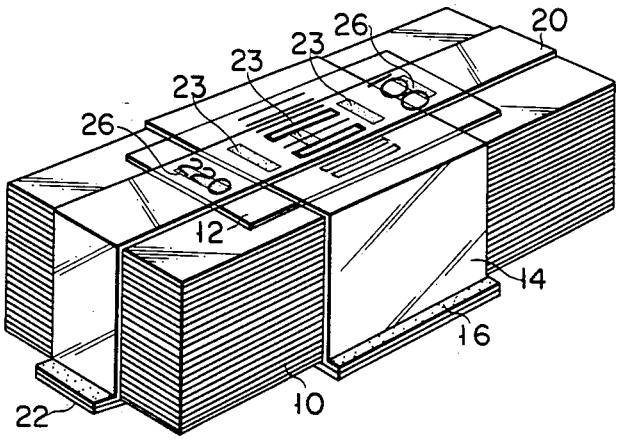
FIG. 4 is an oblique view showing a bundle of sheets of paper bound by a fourth embodiment according to the present invention.

FIG. 4 depicts a fourth embodiment, the tape 14 is wound around stack 10, both ends of the tape 14 being heat adhered with one another and at the same time, both the tape 14 and the label 12 are heat adhered at the heat adhering portion as shown by reference numeral 23, and thus initially fixing the label 12. Thereafter, the other tape 20 is wound around so as to crisscross the tape 14, and both ends of the tape 20 are heat adhered, while at the same time, the other tape 20 and label 12 are heat adhered at the heat adhering portions as shown by the reference numeral 26. Thus since the label 12 is heat adhered to both tapes 14 and 20, the label 12 is more securely held in position. However, heat adhesion of the label 12 may also be accomplished by adhering it only to the tape 14.

Although both ends of the tape 14 and/or the tape 20 have been described above as being heat adhered, this invention is not limited to the heat adhesion of tapes, but may as well employ the use of a certain type of adhesive agent for achieving the desired adhesion.

What is claimed is:

1. A method for bundling sheets of paper or the like comprising:

a first step of stacking the sheets of paper;

a second step of positioning a nonadhesive first side of a label adjacent to and in contact with an uppermost sheet in the stack, said label also having a printable side, opposite to said first side upon which bundle identifying information is printed;

a third step including (a) winding, one direction, the stacked sheets of paper with a transparent tape made of a heat-activated adhesive material such that the tape extends across the printable side of the label in said one direction so that at least one portion of the tape is in registry with the printable side thereof, whereby the bundle identifying information is visually perceivable through the wound tape and (b) superposing both end portions of the tape with each other such that both end portions of the tape are contact with each other;

a fourth step of heating the superposed end portions of the wound tape to heat adhere both end portions to each other without heat adhering the transparent tape to the sheets in the bundle to firmly hold the stacked sheets of paper; and a fifth step of heating only the one portion of the tape in registry with the label so that the label is heat-adhered only to the tape and not to the uppermost sheet in the stack by virtue of heat-adherance between the printable side and the registered portion of the tape and by virtue of the nonadhesive first side of the label being in contact with the uppermost sheet in the stack.

2. The method according to claim 1, wherein the fifth step is performed approximately simultaneously with the fourth step.

3. The method according to claim 1 wherein, in the third step, the tape crosses the label in approximately the central part of the label with both its ends protruding out from the tape.

4. The method according to claim 1, wherein the tape is wound around the stacked sheets of paper with a single turn in the third step.

5. The method according to claim 1, wherein the fifth step is performed after the fourth step.

6. A method for bundling sheets of paper or the like comprising:

a first step of stacking the sheets of paper;

a second step of positioning a nonadhesive first side of a label adjacent to and in contact with an uppermost sheet in the stack, said label also having a printable side, opposite to said first side upon which bundle identifying information is printed;

a third step including (a) winding the stacked sheets of paper with a first transparent tape made of a heat-activated adhesive material such that the first tape extends across the printable side of the label in said one direction so that at least one portion of the first tape is in registry with the printable side of the label whereby the bundle-identifying information is visually perceivable through the first tape, and (b) superposing both end portions of the first tape with each other such that both end portions of the tape are in contact with each other;

a fourth step of heating the superposed end portions of the wound first tape to heat adhere both end portions to each other without adhering the first tape to the sheets in the bundle to firmly hold the stacked sheets of paper in said one direction;

a fifth step, performed after said fourth step, of heat adhering the label to the first tape;

a sixth step, performed after said fifth step, including (a) winding the stacked sheets of paper having the first tape thereon with a second transparent tape, made of a heat-activated adhesive material, in a direction perpendicular to said one direction, the second tape being wound around the stack of sheets in said perpendicular direction so that a portion of the second tape crosses the first tape over said registered portion thereof, and (b) superposing both end portions of the second tape with each other such that both end portions of the second tape are in contact with each other;

a seventh step of heating the superposed end portions of the wound second tape to heat adhere both end portions thereof to each other without adhering the second tape to the sheets in the bundle to firmly hold the stacked sheets in said perpendicular direction; and a eighth step of heating a portion of the second tape which crosses the registered portion of the first tape so that the label is heat adhered only to the first tape and not to the uppermost sheet in the stack by virtue of heat-adherence between the printable side and the registered portion of the first tape and by virtue of the nonadhesive first side being in contact with the uppermost sheet in the stack, wherein said seventh step of heating also heat adheres that portion of said second tape which crosses the registered portion of the first tape, and wherein said identifying information is visually perceivable through the first and second transparent tapes.

7. The method according to claim 6, wherein the eighth step is performed approximately simultaneously with the seventh step.

8. The method according to claim 6, wherein the eighth step is performed after the seventh step.

9. The method according to claim 6, wherein the second tape crosses the first tape on the label in the sixth step.

10. The method according to claim 9, which further comprises a ninth step performed between the third step and the sixth step, the ninth step being practiced by applying an adhesive to that portion of the first tape which crosses the second tape, on the other side of the stacked sheets of paper, thereby adhering the second tape with the first tape on the other side.

11. The method according to claim 10, wherein the ninth step is performed after the fourth step.

* * * * *